US008206130B2

(12) United States Patent
Pecorari et al.

(10) Patent No.: US 8,206,130 B2
(45) Date of Patent: Jun. 26, 2012

(54) HYDRAULIC MOTOR HAVING RADIAL CYLINDERS CAPABLE OF HIGH SPEED ROTATION

(75) Inventors: Vittorio Pecorari, Modena (IT); Davide Pecorari, Modena (IT)

(73) Assignee: S.A.I. Societa' Apparecchiature Idrauliche S.p.A., Modena (IT)

( * ) Notice: Subject to any disclaimer, the term of this patent is extended or adjusted under 35 U.S.C. 154(b) by 704 days.

(21) Appl. No.: 12/226,444

(22) PCT Filed: Apr. 20, 2006

(86) PCT No.: PCT/IT2006/000268

§ 371 (c)(1),
(2), (4) Date: Feb. 26, 2009

(87) PCT Pub. No.: WO2007/122644

PCT Pub. Date: Nov. 1, 2007

(65) Prior Publication Data

US 2009/0301291 A1 Dec. 10, 2009

(51) Int. Cl.
*F04B 27/04* (2006.01)

(52) U.S. Cl. ..... 417/273; 417/271; 417/506; 417/571

(58) Field of Classification Search ..... 417/269, 417/271, 273, 506, 571
See application file for complete search history.

(56) References Cited

U.S. PATENT DOCUMENTS

| | | | |
|---|---|---|---|
| 3,521,614 | A | 7/1970 | Orkney |
| 3,696,710 | A | 10/1972 | Ortelli |
| 6,302,663 | B1 | 10/2001 | Schuller et al. |

FOREIGN PATENT DOCUMENTS

| | | | |
|---|---|---|---|
| DE | 196 20 701 | A1 | 1/1997 |
| EP | 0 270 181 | A2 | 6/1988 |
| FR | 2 243 610 | | 4/1975 |
| FR | 2 822 199 | | 9/2002 |
| GB | 527359 | | 10/1940 |
| GB | 1 520 912 | | 8/1978 |
| WO | WO 99/17021 | | 4/1999 |

OTHER PUBLICATIONS

International Search Report dated Mar. 13, 2007.

*Primary Examiner* — Vip Patel
(74) *Attorney, Agent, or Firm* — McGinn IP Law Group, PLLC

(57) ABSTRACT

A radial cylinder hydraulic motor comprises: oscillating hydraulic cylinders (1) driven to oscillate by means of an eccentric crankpin (2) formed on the motor shaft (3), the oscillating cylinder liners (4) being provided with trunnions (5) for oscillation about a parallel axis (C) to the axis (A) of rotation of the motor shaft which are coupled oscillably to the motor crankcase (6); reciprocating pistons (7) within said liners which are provided with a runner (8) for sliding over the outer surface (9) of said eccentric crankpin; and a rotary disk distributor (10, 23) coupled to the motor shaft for synchronized rotation therewith, adapted to place the conduits (12, 13) of the hydraulic circuit in fluid communication with the conduits (14) of the respective cylinders during the delivery and discharge strokes via ports of slanted or through-going configuration; and advantageously includes the rotating disk of the distributor formed with a connection/supply means (38, 40) to the passageway between one face (27) and the inner wall of the distributor cover (41) incorporating a seal (28), with pressurized fluid in the area outside the seal. In another embodiment, it has the trunnions (5) formed with trough-like channels (30) in their outer surface (31), at the area of rubbing contact with the trunnion journals, into a branched layout (30) having a roughly trapezoidal projected shape, the channels in the branched layout being supplied pressurized fluid through one or more supply channels (32) from within the cylinder.

13 Claims, 3 Drawing Sheets

HYDRAULIC MOTOR HAVING RADIAL CYLINDERS CAPABLE OF HIGH SPEED ROTATION

FIELD OF APPLICATION

The present invention relates to a radial cylinder hydraulic motor adapted for operation at high rotational speeds, in particular a radial cylinder hydraulic motor with oscillating radial cylinders which complements the slow-running characteristics of radial cylinder hydraulic motors with high rotational speed capabilities.

PRIOR ART

Hydraulic motors have been known in the art wherein radially arranged cylinders act on a common, centrally located crankpin or eccentric, and wherein oscillating cylinders are provided for driving the piston runners slidingly over the crankpin or eccentric.

Conventional motors include a distributor of suitably flattened cylinder or disk-like shape which is formed with a number of through-going holes in communication with a first branch of the hydraulic circuit that rides on a first face opposed to a second face and lies next to the individual feed/discharge conduits of the respective cylinders, and which is formed with slanted holes communicated to a second branch of the hydraulic circuit that rides on the peripheral cylinder surface of the disk-like distributor opposite said second face. The set of through-going communication holes are grouped in a different region lying diametrically opposed from the set of slanted holes in said second face.

It is recognized that the back-and-forth flow of hydraulic fluid through the distributor and the individual conduits result in head losses, vibration and cavitation as the rotational speed rises above 500-600 rpm, a common occurrence with this kind of motor with radial cylinders. Also, at high rotational speeds, the seal provided in the first face affects an unbroken flow to the passageway between the face and the sealing cover, so that the seal tightness under all conditions of operation cannot be maintained.

Accordingly, disk-like distributors are unsuitable for use in high rotational speed applications, despite their capability to retain a smaller amount of liquid in the idle gaps between them and the cylinders compared with cylindrical distributors of axial extension.

In addition, the oscillation trunnions of the cylinder liners tend to lack lubrication between the trunnion and its journal, especially with cylinders that have a limited oscillation angle, as is the case with small displacement motors having cylinders of a relatively large size, but also with variable displacement motors. In fact, motors having large-size cylinders and a limited range of oscillation, where the motor has a variable displacement feature achieved by decreasing the throw for operation at reduced displacement, often develop uneven lubrication at their contact surfaces between the journal and the trunnion, which can eventually result in damaged surfaces especially if the oscillation occurs at a fast rate. i.e. when the motor is run at high rpm.

Prior proposals aimed at overcoming the last-mentioned problem by a direct supply of pressurized fluid from the cylinder have proved unsatisfactory at high rotational speeds that turn any lubrication adopted in the past into a critical and relatively unreliable factor, by reason of the minimum displacement setting (i.e., minimum range of oscillation) and the high output power (large reaction force).

Furthermore, prior proposals aimed at reducing the presence of idle spaces provide for the hydraulic pistons to be of hollow construction and formed with a drawn or pressed dome in an interference fit to a drawn body, thereby keeping the reciprocating masses small at a notable sacrifice in cost. Pistons are, however, mostly constructed from an open-top, hollow cylinder tube section which is shrunk onto a massive body conventionally formed with a lubrication hole to the underlying runner that rides on the outer surface of the crankpin/eccentric.

Thus, no simple and economically convenient way of making lightweight hollow pistons is provided in the state of the art.

To sum up, the limitations to the state of the art stand against the design of a radial cylinder hydraulic motor that, while being cost-effective, can exceed the rotational speed of radial cylinders customarily put at 600 rpm, and still perform satisfactorily from a mechanical and volumetric efficiency.

Accordingly, the technical problem underlying this invention is to provide a radial cylinder hydraulic motor with a distributor which can run at rpm above the prior art limit without incurring any large losses from hydraulic resistance, excess vibration, and shocks in going through the cylinder conduits between the delivery and discharge ends of the hydraulic circuit.

Another, no less important object of the invention is to provide a hydraulic motor with mechanical parts, in particular cylinder trunnions, adapted for operation at a reduced oscillation range and/or sliding contact with each other, thereby allowing rotation at high rpm (i.e., large cylinder oscillation).

A further, no less important object of the invention is to provide the hydraulic motor with reciprocating parts (i.e. pistons) of reduced mass, and to diminish the residual idle volumes within the motor during operation, the latter being a major factor for high-speed operation in a cost-effective way.

SUMMARY OF THE INVENTION

The above technical problem is solved by this invention providing a radial cylinder hydraulic motor which comprises: oscillating hydraulic cylinders driven to oscillate by means of an eccentric crankpin formed on the motor shaft, the oscillating cylinder liners being provided with trunnions for oscillation about a parallel axis to the axis of rotation of the motor shaft, which are coupled oscillably to the motor crankcase; reciprocating pistons within said liners which are provided with a runner for sliding over the outer surface of said eccentric crankpin; and a rotary disk distributor coupled to the motor shaft for synchronized rotation therewith, adapted to place the conduits of the hydraulic circuit in fluid communication with the conduits of the respective cylinders during the delivery and discharge strokes via ports of slanted or through-going configuration; characterized in that the rotating disk of the distributor includes a connection/supply means to the passageway between one face and the inner wall of the distributor cover incorporating a seal, with pressurized fluid in the area outside the seal.

In a preferred embodiment, the passageway connection/supply means comprises a depression extending parallel to the passageway.

In another embodiment, said passageway connection/supply means comprises at least one hole communicating to one of the slanted configuration ports; each slanted configuration port advantageously incorporating a hole of large diameter for communicating the passageway to the port.

In a further preferred embodiment, the trunnions are formed with trough-like channels in the outer surface thereof, at the area of rubbing contact with their journals, thereby forming a branched channel layout of roughly trapezoidal projected shape; the branching channels being supplied the pressurized fluid from one or more of the supply channels inside the cylinder.

In another embodiment, said trough-like channels at the major side of the roughly trapezoidal shape lie close to the area of attachment of the cylinder trunnion to the liner; additionally, at least one blind channel in the branched layout extends from the channel defining said major side of the roughly trapezoidal shape to the middle of the branched layout.

In an improved embodiment, the pistons are constructed to advantage from a tube secured on the piston base and having said runner attached thereto; the head of a mushroom plug is an interference fit inside the remote tube portion from the base; the stem of the mushroom plug is an interference fit in the base, and is formed with a coaxial intake hole for the pressurized fluid utilized to lubricate the runner through the hole in the base.

The features and advantages of this invention, relating to the construction of a radial cylinder hydraulic motor, should be apparent from the following description of embodiments thereof, given by way of non-limitative examples with reference to the accompanying drawings.

DETAILED DESCRIPTION OF A PREFERRED EMBODIMENT

Figure 1:
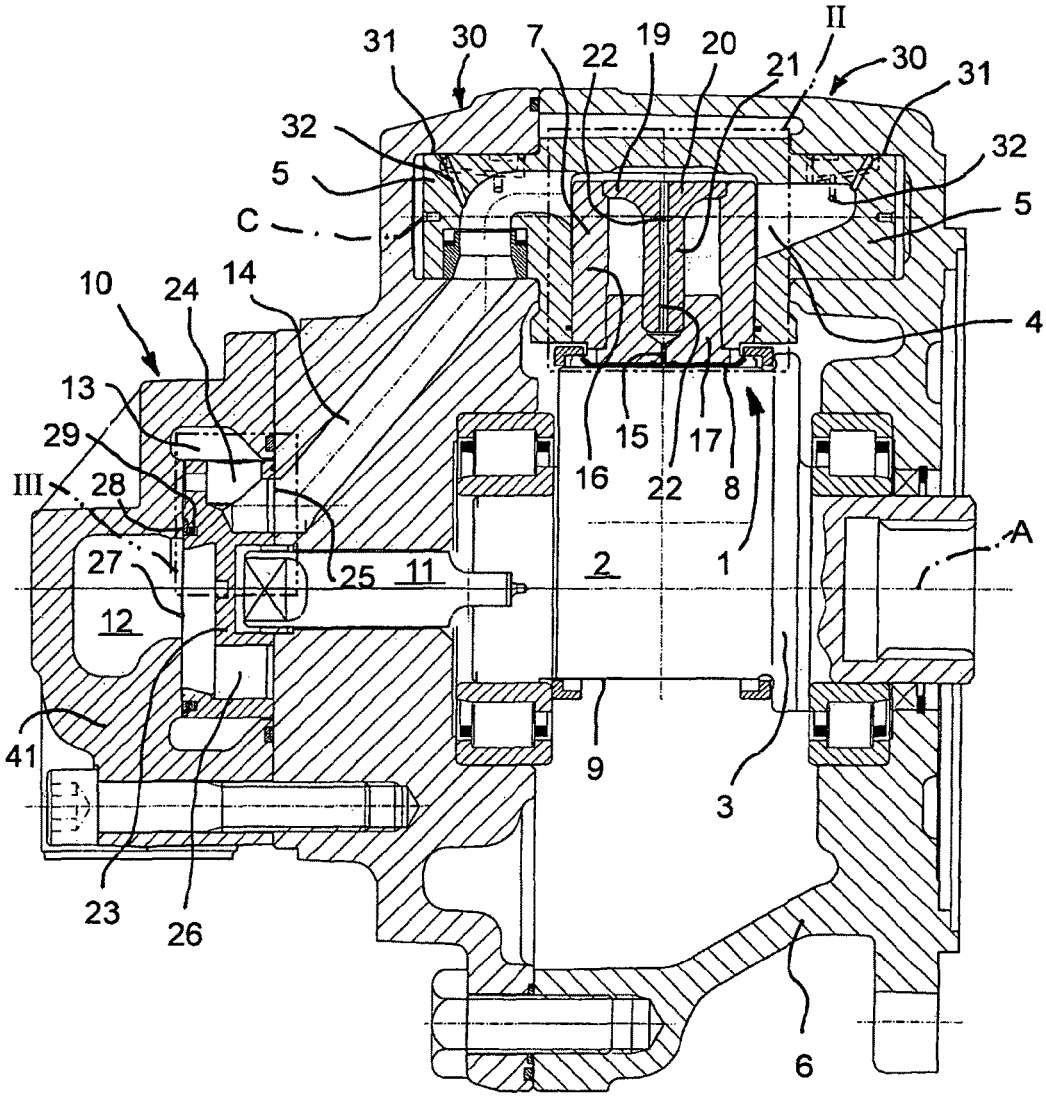
FIG. 1 is a sectional view of a hydraulic motor embodying this invention, i.e. comprising component parts to be described.
Figure 2:
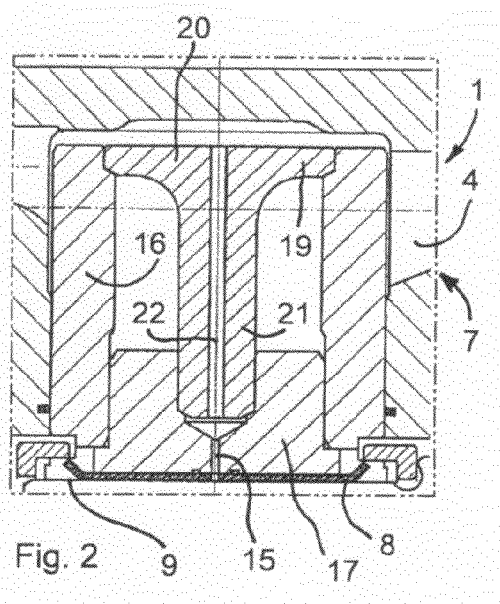
FIG. 2 is an enlarged sectional view of an area II in FIG. 1, illustrating the improved construction of the individual pistons.

Shown in FIG. 1 is a radial cylinder hydraulic motor comprising: oscillating hydraulic cylinders 1 which are driven to swing by means of an eccentric crankpin 2 of the motor shaft 3; the liners 4 of the oscillating cylinders are provided with trunnions 5 for oscillation about a parallel axis C to the axis A of rotation of the motor shaft mounted in the motor crankcase 6; the pistons 7 are reciprocated inside said liners and provided with a runner 8 for sliding over the outer surface 9 of said eccentric crankpin 2; the motor includes a rotary distributor 10 which is coupled, through the drive pin 11, to rotate synchronously with the motor shaft 3, and is adapted to place the conduits of the hydraulic circuit 12 and 13 in fluid communication with the conduits of the respective cylinders 14 during the delivery and discharge strokes.

The pistons 7 are conventionally formed with a lubrication hole 15 for lubricating the area between the runner 8 and the outer surface 9 of the crankpin 2; in addition, the pistons comprise a tube 16 which is attached to the base of the piston 17 on which said runner 8 is secured conventionally; the head 19 of a mushroom plug 20 forms an interference fit with the inside diameter of the remote portion 18 of the tube from the base 17, the stem 21 of the mushroom plug being an interference fit in the base 17 and formed with a coaxial intake hole 22 for the pressurized fluid directed to lubricate the runner 8 through the hole 15 in the base 17.

The rotary distributor 10 comprises the rotary distributor disk 23 and is conventionally formed with intake ports to the respective oscillating cylinders 1 at the appropriate timing. The disk has slanted configuration ports 24 for communicating the hydraulic fluid conduit 13 to the second face 25, and has the through-going configuration ports 26 between the first face 27, adjoining the hydraulic fluid conduit 12, and the second face, the ports 26 being provided in a remote region from the slanted configuration ports 24. The first face 27 is provided with a conventional seal 28 comprising an outer ring of metal, an extrusion-resisting ring, and a circular cross-section ring received in an annular seat 29, for the purpose of isolating the passage between said through-going configuration ports 26 in the flowpath of the fluid from the conduit 12 to the compartment of the distributor cover 41.

FIG. 1 is a partial view of the branched layout 30 in the bearing surface 31 of the trunnions 5 of the liner 4 of the hydraulic cylinder 1. The branched layout is supplied pressurized hydraulic fluid through holes 32 inside the cylinder.

Figure 4:
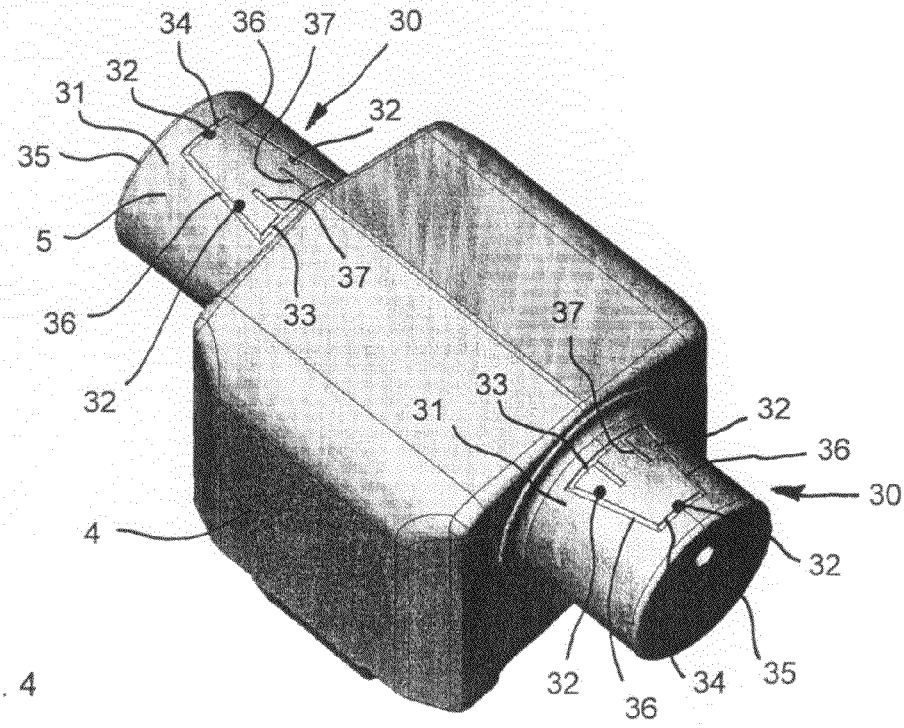
FIG. 4 is a diagramatic perspective view of an oscillating cylinder liner in the improved embodiment of the trunnions according to the invention.

The branched layout 30 in the surface 31, being conventionally formed of small hydraulic fluid distribution channels, is best illustrated by FIG. 4, where a configuration with an approximately trapezoidal projected shape is shown to have a channel 33 defined by the major side extending close to the joint of the trunnion 5, i.e. close to the liner 4, and to have a channel 34 defined by the minor side extending close to the trunnion end 35; furthermore, said sides are connected by channels along the sloping sides 36, and blind channels 37 toward the centre of the branched layout of trapezoidal projected shape are communicated to the major side.

Figure 3:
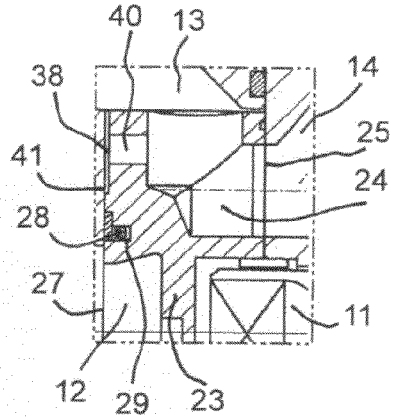
FIG. 3 is an enlarged sectional view of an area III in FIG. 1, illustrating the improved construction of the distributor disk.
Figure 6:
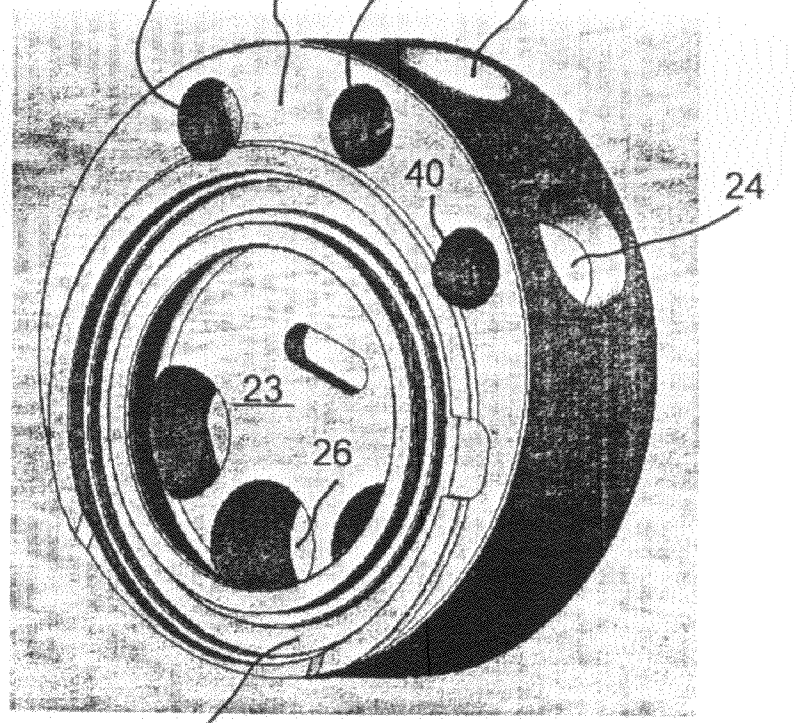
FIG. 6 is a diagramatic perspective view of the rotary distributor disk, as viewed from another angle than in FIG. 5.
Figure 5:
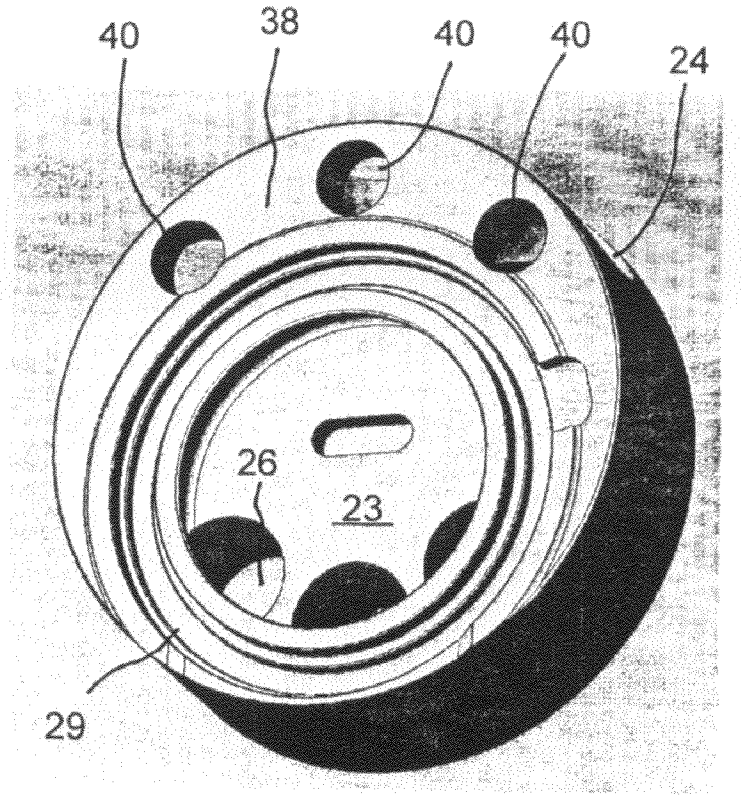
FIG. 5 is a diagramatic perspective view of the rotary distributor disk, as viewed from the remote end of the communication conduits to the hydraulic cylinders.

FIGS. 3, 5 and 6 illustrate the shape of the first face 25 of the disk 23 of the distributor 10, where a depression 38 is provided outside the annular seat 29 and additional through-going axial holes 40 extend from the slanted configuration ports 24 to said depression; the depression expands the passage between said first face and the cover of the distributor 41. Thus, the annular seat 29 with the conventional seat 28 can be supplied with the fluid even at a high rotational speed of the distributor. The hydraulic fluid collected in the depression 38 will maintain a pressure onto the seal 28 from outside, although most of the pressure will come from the conduit 13, i.e. through the outside diameter of the distributor disk, thereby preventing a hydraulic short from occurring in the distributor at high rotational speeds, as is instead common occurrence with the rotating disks of a conventional distributor.

The assembly of the piston 7 described above, while being carried out through simple modifications of an ordinary piston for hydraulic motors, is easy to perform, since it only provides for minor modifications to the process of machining the tube 16 and the base 17 in order for them to receive the head 19 and stem 21 of the mushroom plug 20 in an interference fit. The resulting piston is of hollow construction, and therefore, has a smaller mass than a solid piston and minimizes the idle gaps. The reciprocating motion of the piston constructed as above will improve the performance of the motor speed-wise and permit running at higher rotational speeds.

The branched layout 30 ensures a distribution of the pressurized hydraulic fluid in the upper bearing region 31 of the trunnion 5 which approaches the distribution of contact pressure of said surface on the trunnion journal. The configuration of the small channels provided achieves a fluid distribution which is matched to the bending strength of the trunnion 5, the trunnion being inflected much the same way as a bracket during high pressure operation, and applying a compressive load to the journal which focuses at the area of attachment to the oscillating liner 4. For this purpose, the configuration of the branched layout 30 has the major side 33 and the blind channels 37 arranged to concentrate most of the fluid flowing out of the holes 32 in that area. Anyhow, a fluid supply hole 32 is also provided in the minor side 34 of the branched layout of trapezoidal projected shape.

Of course, a skilled person in the art may variously modify the radial cylinder hydraulic motor described hereinabove in order to meet contingent requirements, such modifications being all encompassed by the proprietorial capacity of this invention as set forth in the following claims.

Thus less advantageously, the three discrete improved aspects—namely, the distributor disk to adapt it for operation at high speeds of rotation under any infeed conditions, the lubrication of the contact surfaces between the trunnions of the individual hydraulic cylinder, and the low-cost lightened construction of the piston—described hereinabove, can be applied separately to an oscillating cylinder hydraulic motor.

The invention claimed is:

1. A radial cylinder hydraulic motor, comprising:

oscillating hydraulic cylinders driven to oscillate by an eccentric crankpin formed on the motor shaft, oscillating cylinder liners being provided with trunnions for oscillation about a parallel axis to the axis of rotation of the motor shaft, which are coupled oscillably to the motor crankcase;

reciprocating pistons within said liners, which are provided with a runner for sliding over the outer surface of said eccentric crankpin; and a rotary disk distributor coupled to the motor shaft for synchronized rotation therewith, adapted to place the conduits of the hydraulic circuit in fluid communication with the conduits of the respective cylinders during the delivery and discharge strokes via ports of slanted or through-going configuration, wherein the rotating disk of the distributor includes a supply path in communication with a passageway between a face of the rotating disk and the inner wall of the distributor cover incorporating a seal, with pressurized fluid in the area outside the seal, and wherein said supply path comprises:

a depression extending parallel to the passageway; and a hole which connects one of the slanted configuration ports to the depression.

2. A radial cylinder hydraulic motor according to claim 1, wherein each slanted configuration port incorporates the hole.

3. A radial cylinder hydraulic motor according to claim 2, wherein the hole comprises a hole of large diameter for communicating the depression to the port.

4. A radial cylinder hydraulic motor according to claim 1, having trunnions formed with trough-like channels in their outer surface, at the area of rubbing contact with the trunnion journals, into a branched layout of roughly trapezoidal projected shape, wherein the channels in the branched layout are supplied pressurized fluid through one or more supply channels from the cylinder inside.

5. A radial cylinder hydraulic motor according to claim 1, wherein the pistons are constructed from a tube secured to the piston base and having said runner attached thereto; wherein the head of a mushroom plug is an interference fit inside the remote tube portion from the base, and wherein the stem of the mushroom plug is an interference fit in the base and is formed with a coaxial intake hole for the pressurized fluid utilized to lubricate the runner through the hole in the base.

6. A radial cylinder hydraulic motor according to claim 1, wherein the depression is formed in the first face.

7. A radial cylinder hydraulic motor according to claim 1, wherein the depression if formed parallel to the first face.

8. A radial cylinder hydraulic motor according to claim 1, wherein the rotating disk includes a second face formed opposite to the first face, and the slanted configuration port is in communication with the second face.

9. A radial cylinder hydraulic motor according to claim 8, wherein the rotating disk further comprises an outer circumferential surface formed between the first face and the second face, and the slanted configuration port is in communication with the outer circumferential surface and the second face.

10. A radial cylinder hydraulic motor, comprising:

oscillating hydraulic cylinders driven to oscillate by an eccentric crankpin formed on the motor shaft, the oscillating cylinder liners being provided with trunnions for oscillation about a parallel axis to the axis of rotation of the motor shaft, which are coupled oscillably to the motor crankcase;

reciprocating pistons within said liners, which are provided with a runner for sliding over the outer surface of said eccentric crankpin; and a rotary disk distributor coupled to the motor shaft for synchronized rotation therewith, adapted to place the conduits of the hydraulic circuit in fluid communication with the conduits of the respective cylinders during the delivery and discharge strokes via ports of slanted or through-going configuration, wherein the trunnions are formed with trough-like channels in their outer surface, at the area of rubbing contact of the trunnion journals, into a branched layout having a roughly trapezoidal projected shape, the channels in the branched layout being supplied pressurized fluid through one or more supply channels from the cylinder inside.

11. A radial cylinder hydraulic motor according to claim 10, wherein the trough-like channels at the major side of the roughly trapezoidal shape lie close to the area of attachment of the cylinder trunnion to the liner.

12. A radial cylinder hydraulic motor according to claim 11, wherein at least one blind channel in the branched layout extends from the channel forming said major side of the roughly trapezoidal shape to the middle of the branched layout.

13. A radial cylinder hydraulic motor according to claim 10, wherein the pistons are constructed from a tube secured to the piston base and having said runner attached thereto; wherein the head of a mushroom plug is an interference fit inside the remote tube portion from the base, and wherein the stem of the mushroom plug is an interference fit in the base and is formed with a coaxial intake hole for the pressurized fluid utilized to lubricate the runner through the hole in the base.

* * * * *